US005205210A

United States Patent [19]

Mathis

[11] Patent Number: 5,205,210

[45] Date of Patent: Apr. 27, 1993

[54] METHOD AND APPARATUS FOR DRY PRINTING USING A HOT EMBOSSING FOIL

[76] Inventor: Walter Mathis, Feldheim 1, CH - 6312 Steinhausen, Fed. Rep. of Germany

[21] Appl. No.: 861,903

[22] Filed: Apr. 1, 1992

[30] Foreign Application Priority Data

Aug. 14, 1990 [DE] Fed. Rep. of Germany ..... 4025712

[51] Int. Cl.[5] ..... B41F 1/07

[52] U.S. Cl. ..... 101/32; 156/209

[58] Field of Search ..... 101/28, 31, 32, 27, 101/23; 156/209, 553, 219, 324

[56] References Cited

U.S. PATENT DOCUMENTS

| | | | |
|---|---|---|---|
| 4,038,917 | 8/1977 | Deligt | 101/23 |
| 4,776,912 | 10/1988 | Laval | 156/209 |
| 5,115,737 | 5/1992 | Amendola | 101/32 |

FOREIGN PATENT DOCUMENTS

| | | | |
|---|---|---|---|
| 528859 | 7/1931 | Fed. Rep. of Germany | 101/32 |
| 805184 | 11/1936 | France | 101/32 |
| 401414 | 11/1933 | United Kingdom | 101/32 |
| 421238 | 12/1934 | United Kingdom | 101/32 |
| 673366 | 6/1952 | United Kingdom | 101/32 |
| 2162126 | 1/1986 | United Kingdom | 101/32 |

*Primary Examiner*—Eugene H. Eickholt
*Attorney, Agent, or Firm*—Hopkins & Thomas

[57] ABSTRACT

In a method for dry printing of a workpiece (1) or printed article through employing a hot embossing foil (6) and embossing die (15) and by the application of heat, pressure and time, a workpiece (1) and the embossing die (15) are moved towards each other, brought into contact with intermediate clamping of the hot embossing foil (6) thereby transferring heat and moved apart again. The hot embossing foil (6) adheres to the workpiece according to the embossing die (15) and, after a cooling down time, is detached from the workpiece (1) with the exception of the printed image. The surface of the workpiece (1), the hot embossing foil (6) and the thinly-formed embossing die (15) are moved in the same direction with equal or corresponding speed in mutual engagement with surfaces in contact. The contact time and the cooling time for the individual surface regions of the embossing die (15) are controlled through the speed and the angles of contact (9, 10).

5 Claims, 5 Drawing Sheets

METHOD AND APPARATUS FOR DRY PRINTING USING A HOT EMBOSSING FOIL

FIELD OF THE INVENTION

The invention refers to a method for dry printing of a workpiece or printed article through employing a hot embossing foil and an embossing die and by the application of heat, pressure and time in which the workpiece and the embossing die are moved towards each other, brought into contact with intermediate clamping of the hot embossing foil thereby transferring heat and moved apart again, whereby the hot embossing foil adheres to the workpiece according to the embossing die and, after a cooling down time, is detached from the workpiece with the exception of the printed image. Also included in this application is an apparatus for this method which has a holding station for the workpiece or printed article, a feeding facility for the hot embossing foil opperating step-wise or continuously, an embossing die which is movable in relation to the holding station built from elastically ductile material, and a heating means for the embossing die. The invention permits the direct hot embossing of workpieces, in particular elastically yielding tubes, bottles or similar. It can also be utilized for the hot embossing of printed articles, in particular labels, with the sheet-feed rotara process or similar, i.e., where the printed article is web-shaped with thin walls and exhibits only negligible elastically yielding properties.

BACKGROUND OF THE INVENTION

The hot embossing foil printing process herein referred to is a dry printing method in which the hot embossing foil adheres to or, respctively, is melted onto the surface to be printed. The hot embossing foil itself consists of a carrier strip, a separating layer, advisably a protective film, the actual ink film, which often contains an additional metallic coating, and the adhesive layer or layer for connecting to the surface which is to be printed, which usually consists of plastic material.

Up until now in hot embossing technology, two main methods have been employed, i.e. on the one hand, the lifting process and, on the other hand, the unrolling process. In the lifting process the workpiece is held in place and the embossing die moved to and fro in a strokelike (lifting) fashion. The embossing die represents a rigid body. In the unrolling process, which is especially used for surface coating of cylindrical or slightly conical parts such as lipstick tubes, jars for cream or similar, the workpiece is moved and unrolled on the embossing die with a line contact. The length of the embossing die corresponds to the embossing development. In doing this a substantial contact pressure must also be attained so that the necessary temperature is achieved within the short time available for the unrolling process.

From DE-PS 34 21 029 a combined lifting/unrolling process is known in which the embossing die is brought into contact with the workpiece through continuous engagement over the entire die surface and, in doing this, the embossing die is given a form corresponding to the shape of the workpiece at least in the region of the die surface. Here, the direction of movement of the continuous engagement is directed perpendicular to the working direction, i.e. to the direction in which the individual workpieces to be embossed are guided through the corresponding apparatus. Thus, workpiece and embossing die are moved relatively towards each other, whereby the workpiece often remains absolutely stationary. However, the embossing die, by virtue of its shape, its characteristic thin-walls and through use of flexible material for its production, is already so yielding that this flexibility can be exploited here in order to, as it were, apply and shape the embossing die to the workpiece during the embossing process. During this procedure this engagement process brings evermore larger surface regions into contact with each other so that, advantageously, the compensation for unevenness of the workpiece and a corresponding by-passing of tolerances is possible. Also with this known method, the position of the printed image can be easily altered and differing hollow body shapes can be served with the same embossing die. Printing position modifications are not a problem. However, a disadvantage with this known method is that different surface regions come into contact with the workpiece successively resulting in differing contact times in the region of the die surface of the embossing die. In particular, with short contact times, like those which are essential for a correspondingly high embossing performance, relatively large differences in the contact times associated with the individual surface regions are the result. These differences in contact times are a disadvantage in every respect because they have a negative surface-zonal influence on the printed image. For example, the greater the angle of contact with a bottle which is to be embossed, the more seriously noticable are these differences in contact times. With the known method it is not possible to provide, for example, a hollow body, with hot embossed printing over the entire perimeter, i.e. over 360°.

An apparatus for dry printing of a workpiece using a hot embossing foil is known from DE-PS 38 29 297 in which the die body of the embossing die and, ultimately, the complete embossing die are constructed so thin and flexible that a local elastic deformation of the embossing die is possible upon engagement with the workpiece in order to equalize the prominent parts and recesses, and therewith to minimize the waste. The embossing die is fitted with a positive force transfer relief on the rear side of the die surface and a pressure pad is used for the local elastic shaping. This aims to keep the thermal and mechanical load on the sensitive embossing die as low as possible. It is thereby possible, advantageously, to bring about a well-directed force distribution for the contact pressure during the embossing process, and to compensate for recesses, unevenness and/or differences in wall thickness, in particular with yielding hollow bodies. It is possible, through a well-directed partial heating of the embossing die, to locally influence the heat transfer. The die surface can also be situated on an endless belt, whereby the embossing process is then carried out with line contact. However, with unrolling, such a line contact demands relatively high temperatures for the embossing die owing to the necessarily short contact time. However, particularly high temperatures damage the embossing die and lead to a reduction in the service life. The arrangement of a positive force transfer relief on the rear side of the die surface produces a certain complication and increase in the production expenses for the embossing die.

SUMMARY OF THE INVENTION

It is the object of the invention to demonstrate a method of the aforementioned general type as well as an associated apparatus with which it is possible to improve the adhesion of the embossed printed image on the workpiece or the printed article respectively, and in fact with high performance.

According to the invention, this is achieved with the method in that the surface of the workpiece, the hot embossing foil and the thinly constructed embossing die are moved in mutual engagement under surface contact in the same direction with equal or corresponding speed and in that the contact time of the embossing die and the cooling time of the hot embossing foil are controlled via the speed and the angle of contact.

In doing this a surface unrolling method is created, so to speak, i.e. a method which is presented as a new path for development besides the lifting process, unrolling process and lifting/unrolling process known up until now. While in the unrolling process known up until now, like in any printing process generally, the printed image is always transferred with line contact, here the step to surface contact has been carried out and, in fact, without loss of performance like it is characteristic for the lifting process. Surprisingly, the advantage appears that identical contact times for each surface region of the embossing die or, respectively, the printed image result from this method so that, in this respect, identical properties are the result. Differences in contact time no longer occur, in any case not with a steadily progressing surface to be printed of the workpiece or printed article respectively. With the new method it is possible to determine the contact time on the one hand and the cooling time on the other independently of each other and apply them consistently to all surface regions of an embossing die or a die surface respectively. This results in an improved adhesion of the embossing image on the workpiece because it is consistent. The contact time can be extended almost infinitely and sensitively tuned through the speed of the movement in the working direction and the angle of contact selected with this to match the pulse-like heating time of the embossing die. In addition, it is also possible to keep the temperature of the embossing die locally different. However, in many cases this is no longer necessary. The contact time and the cooling time can be easily and accurately altered or, respectively, adjusted and in fact for the respective printed image; this results in the possiblity of advantageously being able to reduce the average temperature of the embossing die because a sufficiently long contact time can be selected for the heat transfer. In this respect, the service life of the embossing die is considerably increased. With the embossing itself, high speeds can be used easily so that even with one-head construction of a corresponding apparatus, a notable increase in performance ensues. The adhesion of the embossing image is thereby not impaired. The embossing pressure can obviously be influenced mainly by the three parameters heat, pressure and time. While up until now in the state-of-the-art the time, as the variable directly influencing the performance owing to the line contact applied, allowed few chances for variation and, therefore, one relied upon changing the parameter heat but, more especially, pressure in the search for improvements through increases in pressure and temperature, the new method seizes the parameter time and develops the, up until now, current parameters heat and pressure in the opposing direction in that the pressure is comparably lowered and the temperature is also comparably reduced. This new direction for development brings about unexpected advantages. It also extends the applicability in that embossing can be carried out directly on a workpiece but also as so-called label printing from roll to roll or also in rotary sheet-fed presses. With the new method it is also easily possible to print onto the entire perimeter, i.e. over 360°, of a hollow bottle made from plastic material, even with an oval cross-section. The new method also allows the use of embossing dies with multiple use whereby an aditional increase in performance can be achieved. By means of the contact time on the one hand and the cooling time on the other, which can be selected separately in advance, an adaptation to the different materials of the hot embossing foil on the one hand and the workpiece or, respectively, printed article on the other can be achieved to suit the particular case. Therewith, the hot embossing foils available can be more universally applied and, in the end, it does not matter what particular plastic material the tube or bottle which is to be embossed is made from. There is a further advantage over the lifting method with the rigid embossing die in that the contacting pressure force need only be effective on a partial section of the surface of the embossing die at the same time.

For the embossing of circular surfaces of workpieces, like also for the label printing and the rotary sheet-fed presses, the speed and the angle of contact during the embossing are kept constant so that different surface regions of the embossing die come into contact with the workpiece successively but, however, corresponding contact times and cooling times result for every surface region. For example, an increase in speed affects every surface region of the printed image in the same way. As new surface regions come into contact so, in direct proportion, other surfaces run out beyond the angle of contact and are no longer engaged. Corresponding contact times ensue for every surface unit or every point on every surface. An increase in speed can be counteracted through increasing the angle of contact in order to achieve equivalent results. Furthermore, if one considers that the heating can also be pulsed and applied in a time-adjusted manner then it is clear that the adhesion of the embossing image can be improved without limiting the performance. Therefore, it is easily possible to attain operating speeds which correspond to those of silk-screen printing stations or which are, in comparison, even higher. This is the case even with application of a single use.

A power band, a pressure pad, a series of pressure rollers or similar can be used to press the embossing die into contact; the thin embossing die is, during the embossing, merely guided according to the surface of the workpiece. This is carried out parallel to each other with the surfaces in contact in the the working direction. It is understood that prior to achieving surface contact and after terminating same, the embossing die, the hot embossing foil and the workpiece must be moved towards or, respectively, apart from each other like it is done already with the lifting process.

It is also possible to select differently large contact angles for the individual elements. Thus, for example, the hot embossing foil can be guided around the workpiece with a greater angle of contact than the embossing die so that, for realizing the cooling time on the appropriate cooling section, contact between the embossing die and the workpiece via the hot embossing foil is avoided. The movement of the embossing die away from the workpiece is possible independently of the guiding away of the hot embossing foil.

The embossing die is preferably heated locally and discontinuously. These heating impulses are provided, in a manner matched to the angle of contact, for the contact time and, in fact, in such a way that the sufficient amount of heat is avialable during the contact time and can be transferred. This preferably happens at a relatively low temperature level in order to increase the service life of the embossing die.

The apparatus for executing the method is characterized according to the invention in that a drive for the movement of the surface of the workpiece and a dive for the embossing die in the working direction are provided, a means for synchronizing the two drives and the feeding facility with respect to the speeds in the working direction is provided and, preferably, adjustable guiding means for the workpiece, the hot embossing foil and the embossing die are provided which, at least during embossing, bring about reciprocal surface contact during the common movement in the working direction. At least the workpiece or the printed article, the hot embossing foil and the embossing die are, therefore, moved in synchronization in order to achieve the surface contact rendered possible by the guiding means. Relative movement of the parts in the working direction is avoided. In particular, with circular workpieces or with label printing on the perimeter of a support roller or similar, it is in many cases unnecessary to provide an additional power band or similar power transmission elements. The guidance and the contact of the embossing die, which can also take over the function of the pressure element in these cases, is sufficient here. Anyway, the work is carried out with very low pressures, the dominant parameter being the time.

The embossing die can be arranged on a belt which extends in the working direction and can be moved back and forth or on an endless belt. This serves for guiding the embossing die. The embossing die itself can be constructed according to the paricular application. It can be provided on the belt in a single or multiple use arrangement. Owing to the local heating effect it exhibits heated and unheated zones. Masks, i.e. unheated zones which mainly serve for consistent contact and guidance, can also be provided on the belt in addition to the embossing die. It is easily possible to already begin surface contact using an unheated mask and to utilize the migration of the embossing die over a section of the angle of contact for the actual contact time in which heat is transferred.

In many cases it may be advantageous if a power band, an arrangement of pressure pads or pressure rollers is provided which keep the embossing die or the belt in surface contact with the hot embossing foil and the tool during the embossing. Although only a relatively small force is transferred via these pressure elements, this force can be nevertheless necessary in order to render possible and guarantee the correct contact of the embossing die. The embossing die itself is certainly a very thin-walled, flexible component which, in addition, in many cases is also subjected to a considerable bending stress. In particular, when the embossing die is arranged in endless form or on an endless belt, the continuous bending stress is produced during operation. The power band or the other pressure elements can be provided with an means for sensitive adjustment of a initial tension or, respectively, a pressure. The contact pressures should not be just small but, in addition, should be adjustable. This is not only true for a contact pressure in total but rather it is also be possible for the power band or other pressure elements transverse to be formed partitioned perpendicular to the working direction and that every part is provided with a means for sensitively adjusting the initial tension or pressure respectively which can be operated individually. Thereby, every surface element of the embossing die can be influenced, so to speak, with respect to the contact pressure in order to also have a well-directed influence on, for example, depressions or other consistent irregularities.

BRIEF DESCRIPTION OF THE DRAWINGS

In the following, embodiment examples of the invention are illustrated and show.

DETAILED DESCRIPTION

Figure 1:
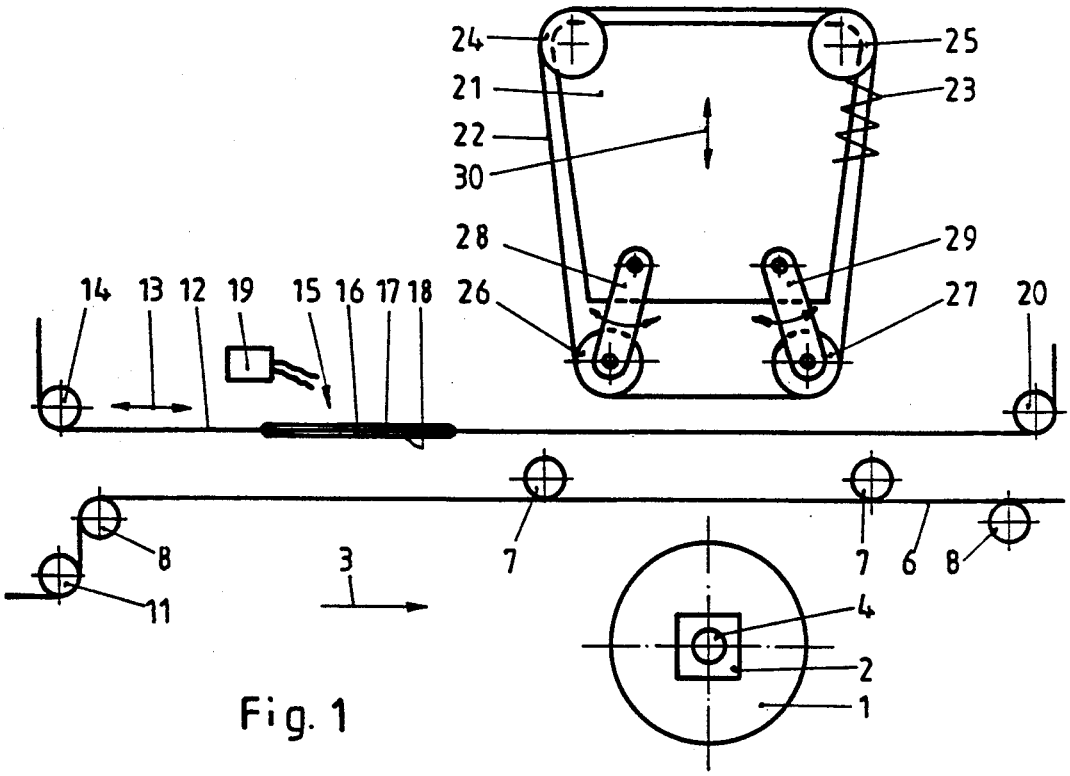
FIG. 1: a schematic side view of a first embodiment of the apparatus for carrying out the method in starting position.

In the Figures the respective parts of the apparatus are only given schematically and in their positions relative to each other. A workpiece 1 is indicated in FIG. 1 which, for example, can be a blown, plastic bottle and is to have the printed image embossed on part of its perimeter. The workpiece 1 is held in a holding station 2, here drawn in simplified form, said holding station being a component of a handling installation, which is not illustrated, which moves the workpieces successively in a step-wise manner through the apparatus. This can, for example, take place in the direction of the arrow 3 or, however, also vertical to the plane of the picture. The holding station 2 is provided with a drive 4 in order to rotate the workpiece 1 during the embossing process (FIG. 2) according to arrow 5. Arrow 5 or arrow 3 respectively thereby both represent the working direction in which the workpieces 1 are successively embossed and run though the apparatus. A hot embossing foil 6 is provided above the workpiece 1 with, at first, a separating gap with respect to this, and this is guided over rollers 7, 8 which are components of a guidance means for the hot embossing foil 6. The rollers 8 can be supported in a fixed position while the rollers 7 can be arranged to swing in and down into the region of the workpiece 1 (FIG. 2) so that, in doing this, they bring the hot embossing foil 6 into contact with the perimeter of the workpiece 1. This results in a total angle of contact, composed of an angle of contact 9 representing the contact time and an angle of contact 10 representing the cooling time, over which the hot embossing foil 6 is in contact with the surface of the workpiece 1. The hot embossing foil 6 is also provided with a drive 11 only schematically illustrated which in this case feeds the hot embossing foil 6 intermittently, i.e. in step-wise fashion, according to arrow 3.

A belt 12 is provided above the hot embossing foil 6 which is formed as an endless flat strip and has a drive 14 controlled step-wise, back and forth, acccording to arrow 13. The belt 12 can consist of one piece of synthetic foil, one thin metal belt or similar. It has an embossing die 15 at at least one point with a mounting body 16 formed through the belt 12, a die body 17 and a die surface 18 which, in the end, is formed according to the printed image desired. The embossing die 15 is intermittently heated via a heating device 19. The embossing die 15 can, in detail, be constructed as is also shown and described in DE-PS 34 21 029 or DE-PS 38 29 297. The belt 12 or rather the embossing die 15 is provided with and moved by means of the drive 14 and a further roller 20 which in turn form a guidance means.

A mounting plate 21 is allocated to the elements described which mainly serves for arranging a power band 22 which is provided with a means 23 for the sensitive application of an initial tension and is otherwise guided via four rollers 24, 25, 26, 27. Here, the roller 24 can be constructed as a drive roller and mounted in fixed position on the mounting plate 21 while the roller 25 is arranged on the mounting plate 21 as a tension roller and can be shifted. The power band 22 is otherwise guided via rollers 26 and 27 which function as pressure rollers. The rollers 26 and 27 are freely rotably supported on levers 28 and 29 whereby the levers 28 and 29 are arranged so they can be pivoted around their support point on the mounting plate 21 and can be locked in order that, in this manner, the angle of contact 9 (see FIG. 2) can be adjusted. Also, during the time in which the heating device 19 is effective and is heating up the embossing die 15, the angle of contact 9 can be influenced to a limited extent. While the belt 12 is made extremely flexible, the power band 22 serves to transmit a sensitively adjustable contact pressure force during the embossing process. This embossing process is illustrated by means of FIG. 2:

Firstly, after the workpiece 1 has come to a stop in the holding station 2 below the mounting plate 21, the rollers 7 and, either afterwards or simultaneously, the mounting plate 21 are lowered in the direction of arrow 30 onto the workpiece 1 so that the relative positions shown in FIG. 2 ensue. Thereupon, the drives 4, 11, 14, 24 are activated in synchronization so that the surface of the workpiece 1 in direction of arrow 5, the hot embossing foil 6 according to arrow 3, the belt 12 with the embossing die 15 according to arrow 13 and the power band 22 also according to arrow 3 move together with sufaces touching, whereby, during the embossing process, the actual embossing die 15 passes under the rollers 26 and 27. The heating device 19 is activated to suit this temporal process and, during the angle of contact 9, the melting-on and pressing-on of the hot embossing foil 6 takes place at the workpiece according to the printed image provided on the die surface 18. The angle of contact 10 for the cooling time follows this procedure. By altering the position of the first roller 7 in accordance with arrow 31, as indicated by the dashed line, the end of the cooling time or rather the angle 10 can be influenced, whereby the geometric boundaries of the two angle of contact 9 and 10 are also determined by the influence of the temperature of the heating device 19. However, as the printed image has now been melted onto the surface of the workpiece 1 with the desired adhesion, the residual hot embossing foil is removed from the surface of the workpiece 1 at the end of the angle of contact 10. Thus, an embossing has been executed. It is to be understood that, during this embossing, the power band 22 was also similarly moved with surfaces in contact via drive 24. As the power band 22 is guided through a somewhat larger radius than that corresponding to the surface of the workpiece 1, the drive 24 must, to avoid a relative movement, run slightly faster than the drive 14 of belt 12 and this in turn must run faster than the hot embossing foil 6 or rather the surface of the workpiece 1. However, the differences only result from the differing radii because, in total, a common movement without any relative movement of the parts while maintaining surface contact must be achieved.

After completing an embossing the individual elements return to their home position according to FIG. 1. The embossed workpiece 1 is passed on by one step and a new workpiece 1 arrives under the mounting plate 21 so that the embossing process can be repeated.

Figure 2:
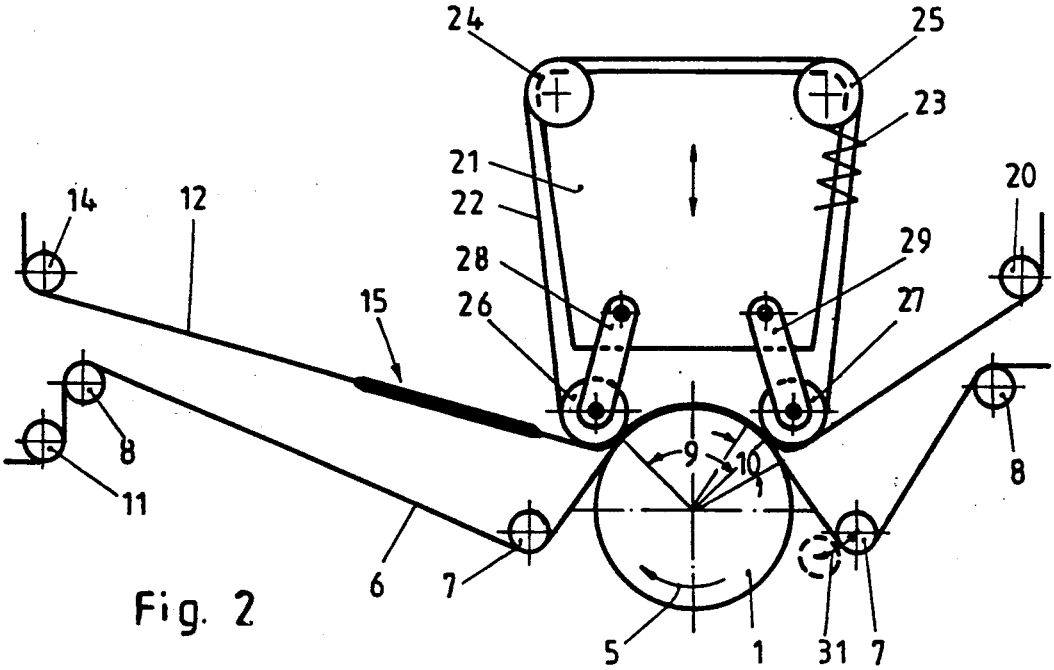
FIG. 2: the apparatus according to FIG. 1 during the operating position.
Figure 3:
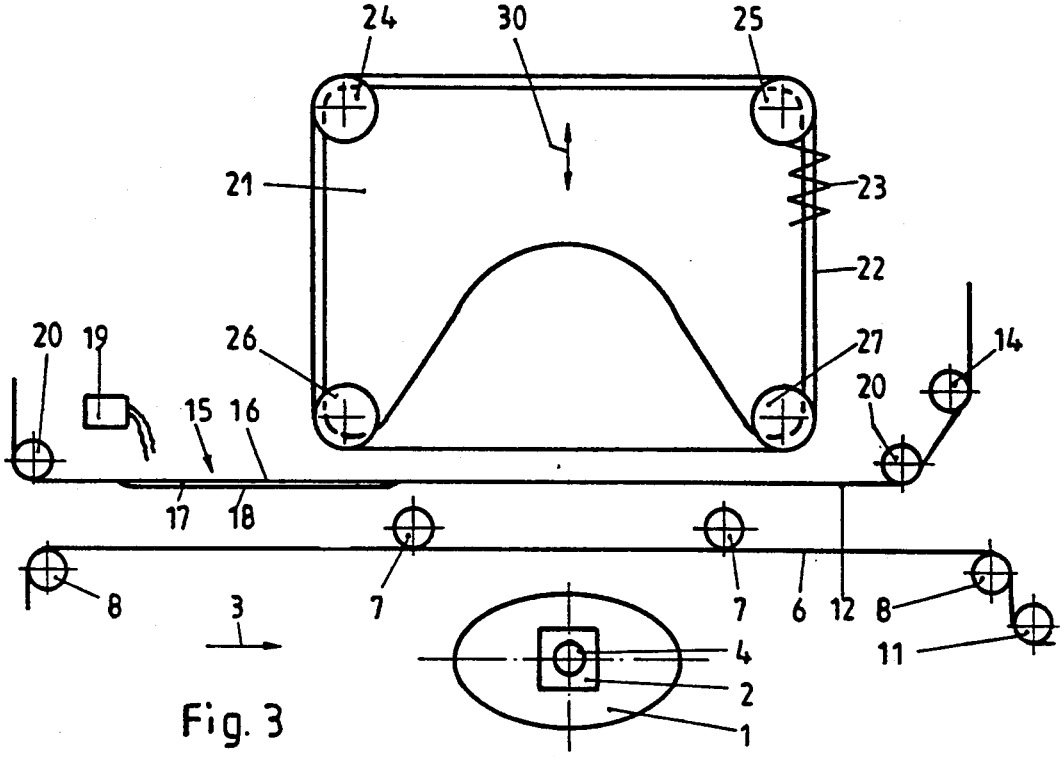
FIG. 3: a second embodiment of the apparatus in home position.
Figure 4:
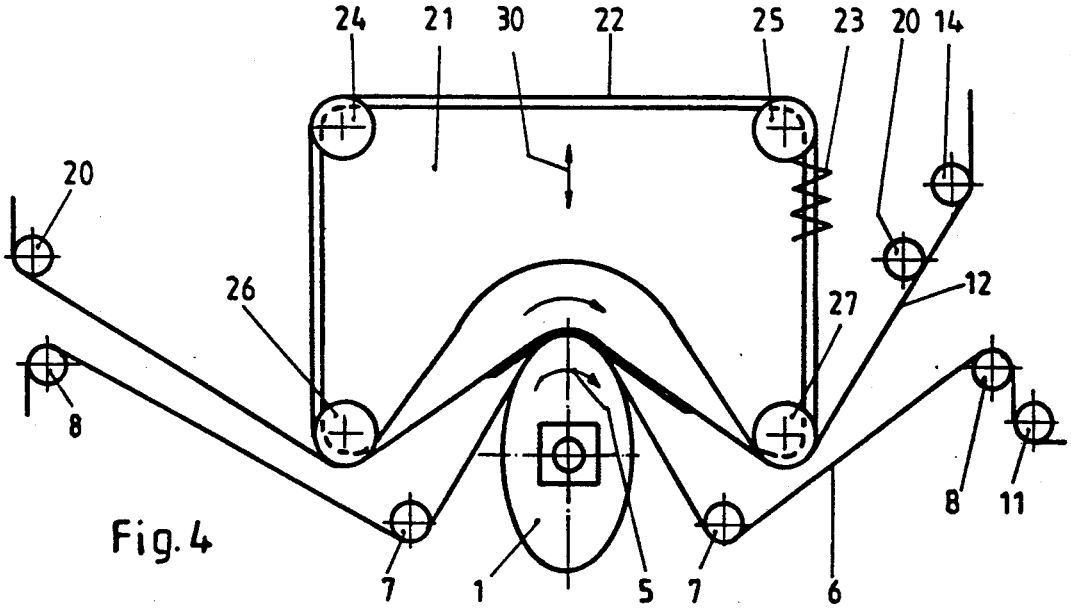
FIG. 4: the apparatus according to FIG. 3 during the operating position.

A very similarly constructed embodiment example to the embodiments of FIGS. 1 and 2 is clearly explained in FIGS. 3 and 4 but by using the example of embossing a workpiece 1 oval in cross-section, for example, a plastic bottle for cosmetics. Here, the rollers 26 and 27 are shown directly supported on the mounting plate 21 although these could, of course, be supported also on levers 28, 29 as shown in the embodiment example of FIG. 1. As the difficulty with this oval bottle is that the respective angle of contacts 9 and 10 change continuously with the movement of the surface of the bottle according to arrow 5, special expenditure is required in order to achieve at least approximately constant contact times and cooling times for the individual surface regions of the surface of the workpiece 1. One possibility is to accelerate or, respectively, brake the synchronous running of workpiece 1, embossing foil 6, embossing die 15 and power band 22 in the sense of changing the semi-axes of the oval crosssection during the embossing of a bottle. Another possibility is to provide the rollers 7, 26 and 27 with a control movement in order to change the angles of contact during the embossing through such movements. Also, a partly different local heating of the embossing die 15 via heating device 19 is advisable. Finally, the initial tension of the power band 22 can be variably controlled during the embossing process by the means 23. It is understood that combinations of these measures can also lead to success.

It is understood that with embossing of the complete perimeter of the workpiece 1 the embossing die 15 on the belt 12 must be constructed correspondingly long. It can also have unheated mask areas through which, firstly, the contacting of the parts to each other is carried out so that finally, the workpiece 1 must be rotated by more than 360° for embossing round the complete perimeter. The construction of the embossing die 15 can be carried out on one or both sides of the belt 12, whereby the printed circuit board arrangement for the heating element, which is situated in the embossing die 15, possibly, may be alone sufficient as force transfer relief. It is here also apparent that the belt 12 with the embossing die 15 represents a very delicate, thin, extremely elastic and locally yielding component which itself tranfers no appreciable forces in the direction of the surface of the workpiece 1. The force transfer is achieved via the power band 22.

Figure 5:
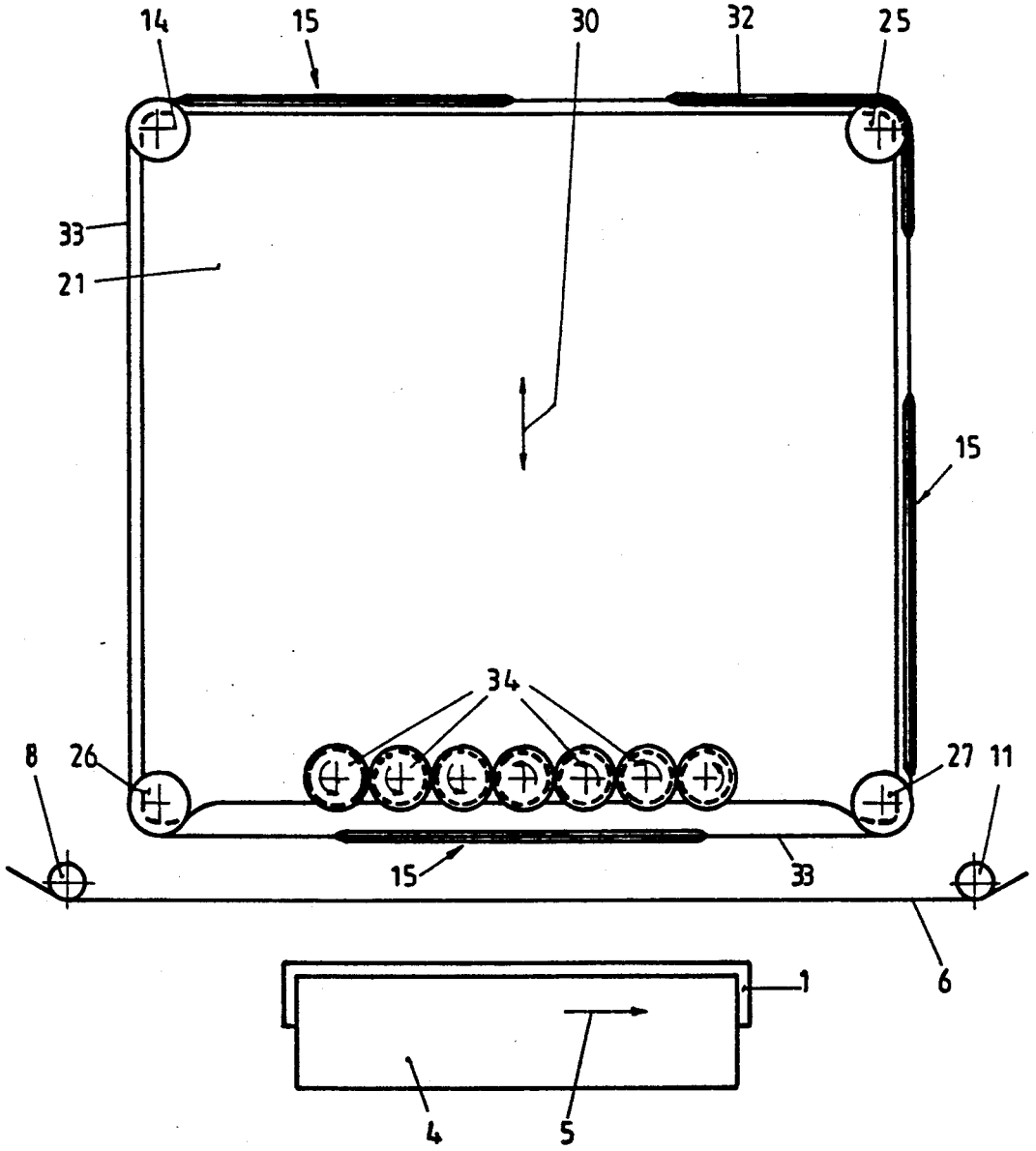
FIG. 5: a third embodiment of the apparatus in home position.

FIG. 5 illustrates an embodiment example in which a plane surface of the workpiece 1 is to be embossed. The workpiece 1 can be here, for example, a lid of a cream jar which is taken up by the holder 4 and conveyed through the apparatus. The holder 4, of which a multiplicity can be usefully arranged here, for example, in the manner of a turntable or similar, is moved in the direction of arrow 5 at least during the embossing. The movement can be continuous. Here, there are several embossing dies 15 and masks 32, i.e. similarly constructed unheated elements, between them arranged in the necessary order on an endless belt 33, whereby the drive 14 is provided as roller on the mounting plate 21. A roller 25 can be constructed as a tension roller. The rollers 26 and 27 here serve for the guidance and for making available the surface contact. The angles of contact are here plane paths in which the embossing die 15 is heated (contact time) and subsequently not heated (cooling time). The drive for the endless belt 33 is advisably continuous. The embossing foil 6 is advisably discontinuously driven but can also be driven continuously. The function of the power band is here taken over by a series of pressure rollers 34 which are best provided with pliable, yielding material around their circumference so that, at any one time during the embossing, there are not only several line-form contacts but surface regions that come into contact. The pressure rollers 34 can be driven themselves or receive their drive indirectly from the endless belt 33. Here also, the mounting plate 21 is movable according to arrow 30 in order to, on the one hand, attain the home position and, on the other hand, attain the embossing position. The pressure rollers 34 can also be travelling or incidented respectively relative to the mounting plate 21 by means of a lifting means, either singly or together. The heating device, here not illustrated, for the embossing die 15 is adapted to the arrangement and influence of the pressure rollers 34.

Figure 6:
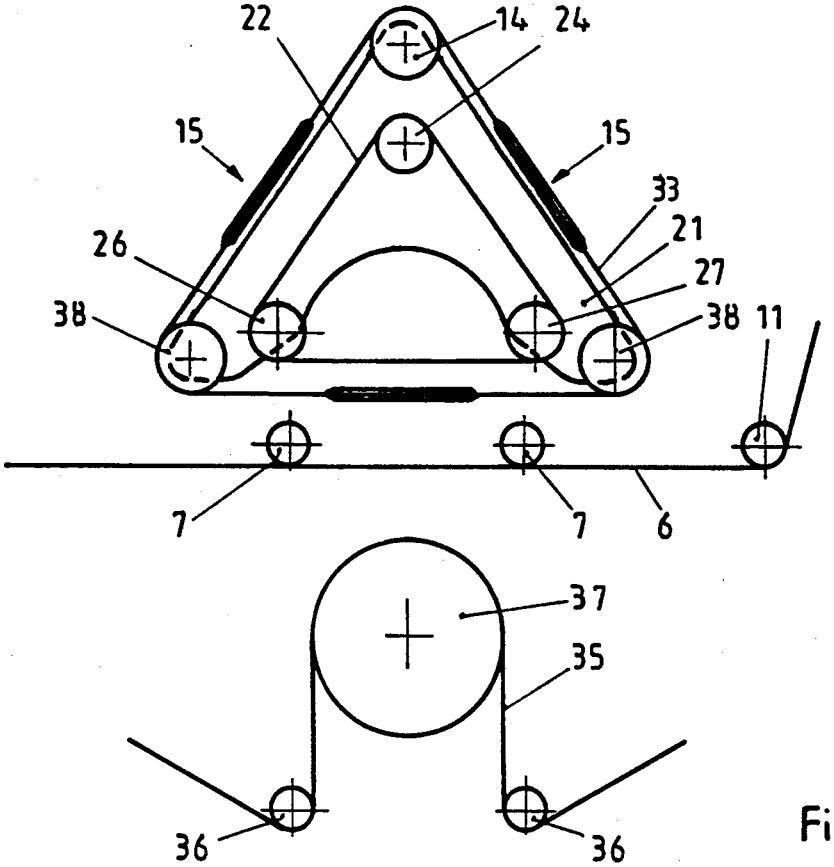
FIG. 6: a further schematic representation of an apparatus in home position.
Figure 7:
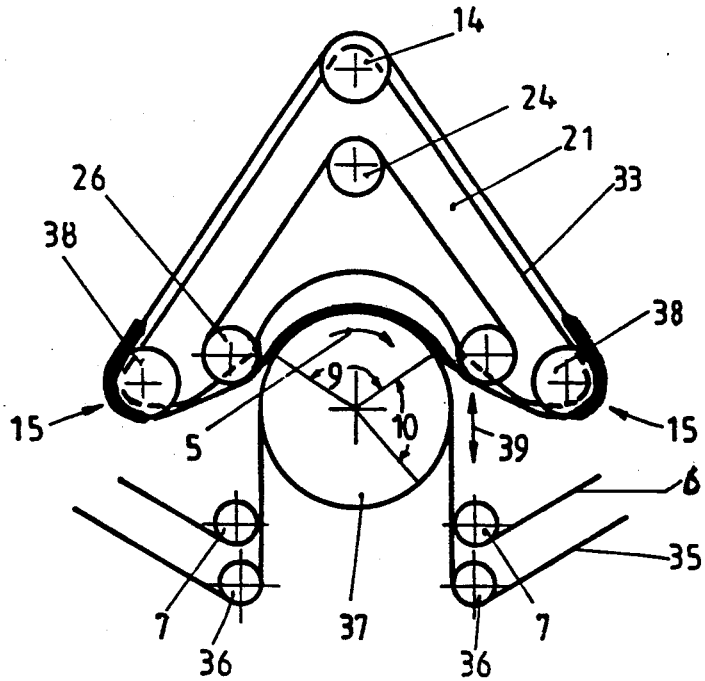
FIG. 7: the apparatus according to FIG. 6 in operating position, i.e. during the embossing.

The further apparatus shown in home position and in operating position in FIGS. 6 and 7 is especially constructed for embossing printed articles. Here, for example, labels can be hot embossed from roll to roll, packaging material or similar. A path or a belt 35, which is continuously guided or, respectively, driven from roll to roll over appropriate idle rollers 36 and a support roller 37 in the area of the embossing station, serves here as workpiece or, respectively, printed article. Here, not only the endless belt 33 with the various embossing dies 15 but also the power band 22 is arranged on the mounting plate 21. The power band is guided over the roller 24, serving as drive, and the rollers 26 and 27. The endless belt 33 is driven via the drive 14 and guided over idle rollers 38. As can be seen from FIG. 7, embossing dies 15 and masks 32 are here, also, alternately arranged on the endless belt 33. In the embossing position shown in FIG. 7, a continuous manner of working can be employed in which, according to arrow 5 around the support roller 37, not only the support roller 37 but also the belt 35, the embossing foil 6, the endless belt 33 with the embossing dies 15 and the masks 32, and the power band 22 are moved continuously, correspondingly in synchronization. The surface unrolling method is particularly clear here. Already, before reaching the angle of contact 9 in which the contact time for heat transfer passes, the belt 35 is brought into contact with the embossing foil 6. An angle of contact 10 follows immediately after the angle of contact 9 and this here realizes a cooling section 39 until the hot embossing foil 6 is removed from the path 35 in the area of the roller 7. The surface unrolling method is especially clear here. The power band 22 here also possesses a non-illustrated means 23 for achieving the desired initial tension. The power band itself can be, for example, a simple metal foil, if there are no tolerances which need to be compensated for. On the other hand, it can have a layer of elastic material in order to compensate for tolerances, depressions or similar. It is also possible to split the power band 22 into several individual power bands divided over the working width in order to be able to adjust different contact pressures forces within each of these narrow pressure belts and bring them into effect, indeed, dependent upon the formation of the printed image to be transferred upon embossing.

Figure 8:
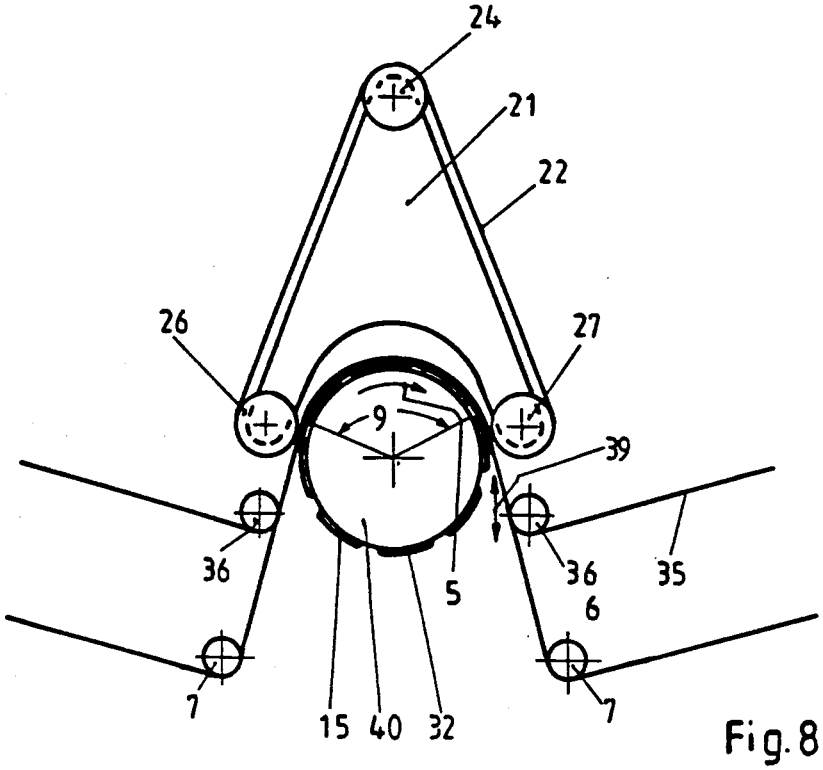
FIG. 8: a modified embodiment during the embossing.

FIG. 8 shows a sort of reversal in the arrangement of the components of the apparatus. Embossing dies 15 and masks 32 are here situated on the surface of a roller 40 around which, firstly, the hot embossing foil 6 is guided via the rollers 7. The belt 35 of the printed article is guided around the idle rollers 36 and, therefore, joins onto the outside. The roller 40 is driven in accordance with arrow 5. The power band 22 is supported and driven on the mounting plate 21. This way also allows the belt 35 to be provided with embossings, whereby the synchronized running of the embossing die 15, the hot embossing foil 6, the belt 35 and the power band 22 is also achieved here. The angle of contact 9 and the cooling section 39 are also to be found here. One can see that here also the contact time and the cooling time can be selected and adjusted separately and independently of each other under surface contact, admittedly to match the heating of the embossing die 15.

Figure 9:
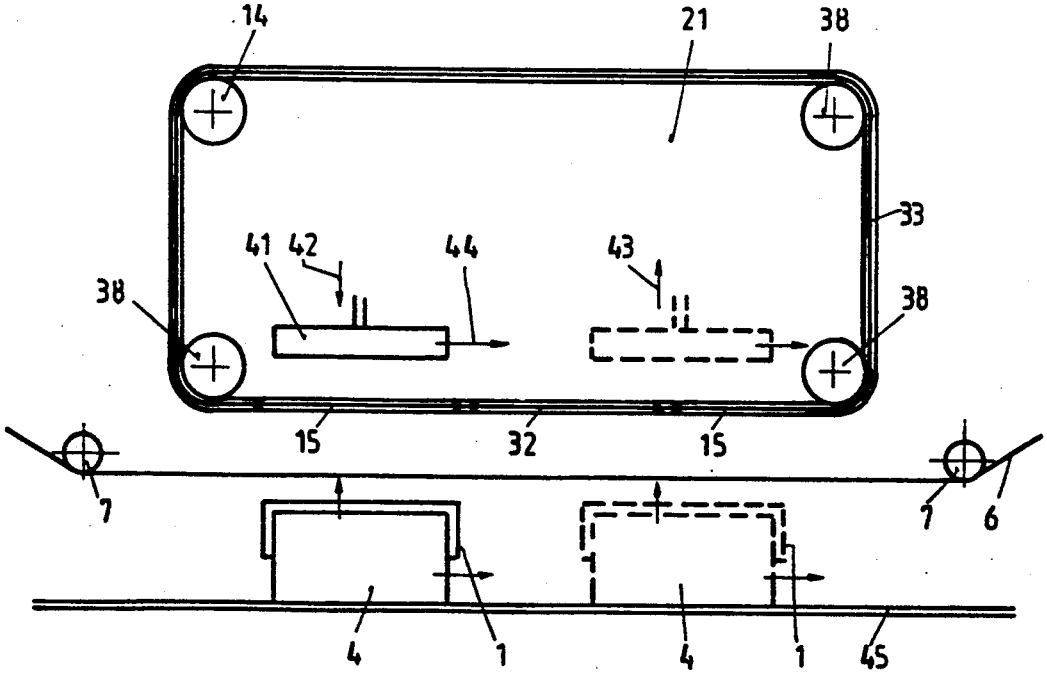
FIG. 9: a side view of a further embodiment in home position.

Finally, FIG. 9 shows a further embodiment. The endless belt 33 with die bodies 15 and masks 32 is arranged on, guided by and driven from the mounting plate 21. The function of the power band is here fulfilled by pressure pads 41 which can be set or rather raised according to the arrows 42 and 43. These pressure pads 41 are also moved during the embossing process in the direction of arrow 44. The holders 4 for the workpieces 1 are here arranged on a conveyor 45 which is passed through the apparatus. Here also, the hot embossing foil 6 is guided and driven over the rollers 7 and between die bodies 15 and workpieces 1. This embodiment example resembles that of FIG. 5, whereby merely the pressure rollers 34 are replaced by the pressure pads 41.

While the preferred embodiments of the invention have been disclosed herein in detail, it will be understood by those skilled in the art that variations and modifications thereof can be made without departing from the scope and spirit of the invention, as set forth in the following claims.

I claim:

1. Method for dry printing onto a workpiece or printed article through application of a hot embossing foil and a thinly formed embossing die and by the application of heat, pressure and time in which the workpiece and the embossing die are moved towards each other, brought into contact with intermediate clamping of the hot embossing foil thereby transferring heat and moved apart again, whereby the hot embossing foil adheres to the workpiece according to the embossing die and, after a cooling down time, detached from the workpiece with the exception of the printed image, characterized in that the surface of the workpiece (1), the hot embossing foil (6) and the thinly-formed embossing die (15) are moved in the same direction in synchronism and in mutual engagement with surfaces in contact, and that the contact time of the embossing die and the cooling time for the hot embossing foil are controlled through the seed and the angles of contact (9, 10, 39).

2. Method according to claim 1, characterized in that for embossing circular surfaces on workpieces (1, 35) the speed and the angles of contact (9, 10, 39) during embossing are maintained at a constant value so that different surface regions of the embossing die (15) successively come into contact with the workpiece (1, 35) but, however, matching contact times and cooling times result for every surface region.

3. Method according to claim 1, characterized in that a power band (22), a pressure pad (41), a series of pressure rollers (34) are used to apply pressure to the embossing die (15), and that the thin embossing die (15) is guided during the embossing merely according to the surface of the workpiece (1, 35).

4. Method according to claim 1, characterized in that the hot embossing foil (6) is guided around the workpiece (1) with a larger angle of contact than the embossing die (15).

5. Method according to claim 1, characterized in that the embossing die (15) is intermittently, locally heated.

* * * * *